US007455419B2

(12) United States Patent
Helget et al.

(10) Patent No.: US 7,455,419 B2
(45) Date of Patent: Nov. 25, 2008

(54) IDENTIFICATION AND/OR TRAIL LIGHT

(76) Inventors: Gerald E. Helget, 507 N. Shore Dr., Forest Lake, MN (US) 55025; Robert Evans, 3241 - 90th Ave., Glenwood City, WI (US) 54013

( * ) Notice: Subject to any disclaimer, the term of this patent is extended or adjusted under 35 U.S.C. 154(b) by 38 days.

(21) Appl. No.: 11/649,547

(22) Filed: Jan. 3, 2007

(65) Prior Publication Data

US 2007/0153525 A1 Jul. 5, 2007

Related U.S. Application Data

(63) Continuation-in-part of application No. 11/324,547, filed on Jan. 3, 2006, now abandoned.

(51) Int. Cl.
*F21V 33/00* (2006.01)

(52) U.S. Cl. ..... 362/191; 362/190; 362/276; 362/253

(58) Field of Classification Search ..... 362/276, 362/802, 431, 190, 191, 197, 198, 199, 119, 362/253; 404/9; 340/691.1, 573.4, 539.1
See application file for complete search history.

(56) References Cited

U.S. PATENT DOCUMENTS

| | | | | |
|---|---|---|---|---|
| 2,549,627 | A | 4/1951 | Musch et al. | |
| 3,685,482 | A * | 8/1972 | Ryder | 116/209 |
| 3,876,970 | A | 4/1975 | Schweitzer | |
| 4,768,139 | A * | 8/1988 | Poppenheimer | 362/302 |
| D375,372 | S | 11/1996 | Allen | |
| 5,772,424 | A | 6/1998 | Nokelainen | |
| 6,299,379 | B1 * | 10/2001 | Lewis | 404/9 |
| D457,670 | S | 5/2002 | Allen | |
| 6,533,435 | B2 * | 3/2003 | Brown | 362/191 |
| 6,764,202 | B1 * | 7/2004 | Herring et al. | 362/371 |
| 6,902,292 | B2 * | 6/2005 | Lai | 362/153.1 |
| D511,769 | S | 11/2005 | Kirakawa et al. | |
| D534,136 | S | 12/2006 | Volgt et al. | |
| D536,632 | S | 2/2007 | Yuen | |
| D538,192 | S | 3/2007 | Martin | |
| 7,301,469 | B1 * | 11/2007 | Hoffman et al. | 340/815.54 |
| 2005/0146874 | A1 | 7/2005 | Cech et al. | |
| 2005/0237208 | A1 | 10/2005 | Wojcik | |
| 2005/0270770 | A1 | 12/2005 | Warrender et al. | |
| 2007/0053742 | A1 * | 3/2007 | Pacholke | 404/9 |
| 2008/0042866 | A1 * | 2/2008 | Morse et al. | 340/691.1 |

FOREIGN PATENT DOCUMENTS

| | | |
|---|---|---|
| DE | 20 2005 013 699 U1 | 8/2005 |
| WO | WO 02/103239 A1 | 12/2002 |

* cited by examiner

*Primary Examiner*—Thomas M Sember
(74) *Attorney, Agent, or Firm*—Gerald E. Helget; Nelson R. Capes; Briggs and Morgan, P.A.

(57) ABSTRACT

An efficient, long lasting identification and trail light that is suitable for marking trails and objects for nighttime identification includes a translucent housing with an internal cavity. A folding tack is mounted on the housing and is movable from a folded away storage position to an extended position for temporarily tacking the housing to an object. An electrical control circuit with a battery are suitably mounted within the cavity. A light is mounted on the housing and is connected to the control circuit. A photocell is connected to the control circuit to actuate battery power to turn on the light in darkness to identify an object or illuminate a trail.

19 Claims, 4 Drawing Sheets

IDENTIFICATION AND/OR TRAIL LIGHT

CROSS REFERENCE TO RELATED APPLICATION

The present application is based on and claims the benefit of U.S. patent application Ser. No. 11/324,547, filed Jan. 3, 2006, the content of which is hereby incorporated by reference in its entirety.

BACKGROUND OF THE INVENTION

The present invention relates to identification or trail lights, and more particularly, to a trail marker light operable principally with an on/off switch and, secondarily, with a light sensitive photocell for energizing an efficient, long-lasting light emitting diode (LED) and capable of attachment to various surfaces such as by a pin or tack, adhesives or Velcro® hook and loop material.

Human beings have two types of nerve cells associated with their eyes. Cones are present and readily differentiate color to the human being. Rods are also in the human eye and generally detect black and white and are more suitable for night vision. Thus, while humans are capable of discerning brilliant colors, they often have difficulty in navigating under low light or night conditions.

Wildlife such as deer, bear, elk and other wild big game, have many more rods than human beings, and almost totally lack red cones and have some blue cones. Hence, wildlife have very limited color vision. They may observe shades of yellow and blue, which they see very well. Thus, it is generally considered that wildlife are colorblind. That is, shades of green, yellow, orange, red, brown, or almost everything else will be seen as shades of yellows while they will see shades of blue very well. The presence of the large number of blue cones and a great number of rods make most wildlife nocturnal animals. Wildlife also lack ultra-violet filters and, hence are thousands of times more sensitive to blue and ultra-violate wavelengths than human beings. This makes wildlife particularly adept to move around in the darkness, seeing shades of blue and yellow, in addition to black and white, and also being able to see ultra-violet, quite unlike human beings. Because wildlife are generally considered colorblind or have dichromatic vision, they have heightened visual sensitivity to movement, especially in low light.

With this background, it is especially difficult for humans to move around and hunt in darkness or low light conditions in the wilderness. This problem is especially acute in that wildlife can readily see, while in the darkness, and have great visual sensitivity to human movement. This is a great preservation characteristic of wildlife.

Humans in the past have moved about in the woods and in nature in darkness with the use of flashlights. Flashlights can be used to guide a human along a trail or be utilized for creating reflections off of certain objects or trail markers to guide the human through the darkness, which is the normal habitat of wildlife. However, the movement of light beams from flashlights are readily discerned by wildlife, gives up the position of humans to the wildlife and alerts them to the potential danger.

There is a need for a highly efficient, long-lasting trail light that is not readily discernable to wildlife and may be easily fixed to naturally occurring objects in the wildlife, such as tree trunks, twigs and bushes. Such a trail light should be efficient and not be operating and wasting energy during the daylight hours but only should come on after daylight is gone and night has set in. Such a light should be readily adaptable for other uses by securing to other objects with readily known adhesives.

SUMMARY OF THE INVENTION

An efficient, long-lasting identification and trail light that is suitable for marking trails and objects for nighttime identification includes a housing with an internal cavity. A folding tack is mounted on the housing and is movable from a folded away storage position to an extended position for temporarily tacking the housing to an object. An electrical control circuit with a battery are suitably mounted within the cavity. A light is mounted on the housing and is connected to the control circuit. A photocell is connected to the control circuit to actuate battery power to turn on the light in darkness to identify an object or illuminate a trail.

A principal object and advantage of the present invention is that the efficient, long-lasting identification and trail light includes an efficient light-emitting diode (LED) of suitable color rendering the light difficult to be seen by wildlife.

Another object and advantage of the present invention is that the photocell connected to the control circuit assures that the identification and trail light is long lasting, requiring no human attendance, as it automatically turns off during daylight hours.

Another object and advantage of the present invention is that the identification and trail light may be safely carried in a pocket because the tack may be folded away into a storage position during non-use.

Another object and advantage of the present invention is that the folding tack permits directional orientation of the identification and trail light for aided viewing in dark or obstructed conditions.

Another object and advantage of the present invention is that the efficient LED light, together with the electrical control circuit and photocell, assure that the identification and trail light will operate unattended for weeks without any discernable movement to wildlife.

Another object and advantage of the present invention is that the identification and trail light may be utilized to mark trails, homes, vehicles and boats, as well as to be arranged to create distress signals.

DETAILED SPECIFICATION

Figure 1:
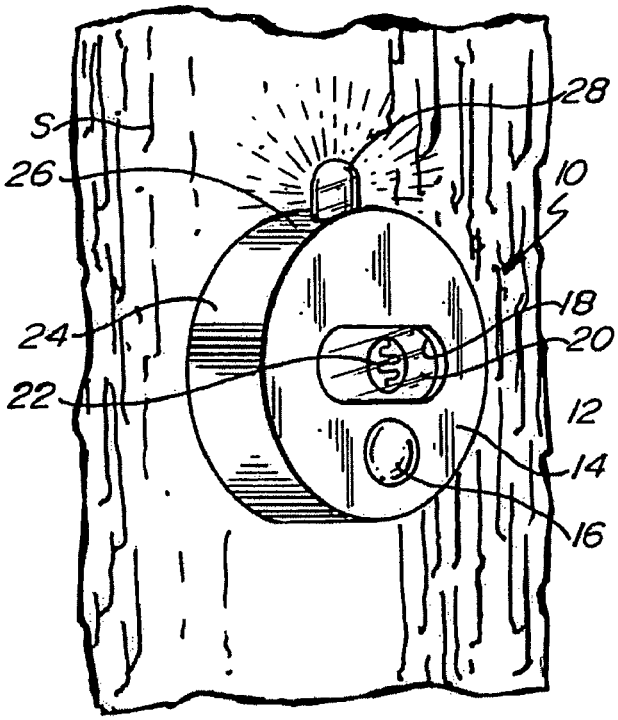
FIG. 1 is a perspective view of the identification and trail light mounted on a tree trunk partially broken away.

The identification and trail light 10 suitably may be mounted on a tree trunk 5 for illuminating a trail in the dark through woods, swamps, fields and open spaces. The trail light 10 generally includes a housing 12, a housing cavity 18, a photocell 22, a light-emitting diode (LED) 28, a movable tack 56, and a control circuit 70 within the housing cavity 18 having a battery 72.

More specifically referring to FIGS. 1-5, the details of the identification and trail light 10 may be appreciated. The housing 12 is suitably a short cylinder suitably made of waterproof plastic. On one end of the housing 12 is a front face or wall 14 having an on/off switch 16 suitably of a sealed dimple-style assuring that the switch is waterproof. Internal of the housing 12 is housing cavity 18. Located on the front face 14 is also a photocell clear cover 20 behind which is mounted the photocell 22 within the cavity 18. The clear cover 20 permits light to enter and reach the photocell 22 but is also waterproof.

The housing 12 has a continuous sidewall 24. The sidewall 24 appropriately has a top 26 whereat is mounted an efficient light-emitting diode (LED) or a PN junction semi-conductor diode 28. The base of the LED 28 passes into the housing cavity 18. At the back of cylindrical housing 12 is a water-tight rear wall or face 50 suitably with a tack recess 52 in the shape of a "T". Leg sockets 54 secure the T-shaped tack 56 by legs 60. The sharp tip 58 of tack 56 may be pivoted from a storage position (FIG. 2) to an extended position (FIG. 3) with its sharp tip 58 suitable for tacking the housing 12 into an object, such as a tree trunk 5, in any of a variety of orientations as to aim the LED 28. Tack 56 may be considered a mechanical linkage for temporarily securing the light 10 to an object. Alternatively, adhesively securable Velcro® hook patch 62 and loop patch 64 may be utilized on the rear wall 50 of the housing to secure the housing 12 to an object capable of receiving patch 62 or 64 for removable positioning of the light 10 on an object. Double-sided adhesive tape will also work as a mechanical linkage.

Figure 4:
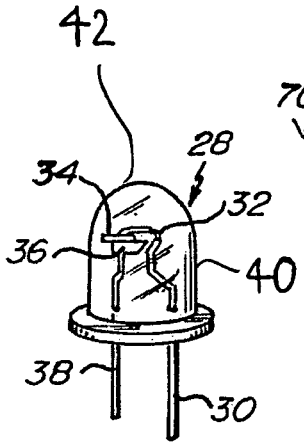
FIG. 4 is a front elevational view of a light emitting diode suitable for the present invention.

Referring to FIG. 4, the LED 28 may be understood. The LED has a positive anode lead 30 extending upward to a whisker 32 adjacent a semi-conductor 34 supported on an anvil 36. A negative cathode lead 38 extends downwardly and out from a high impact plastic enclosure 40, the top of which is suitably a lens 42. Shades of red and green lights are ideally suited for this application.

Figure 5:
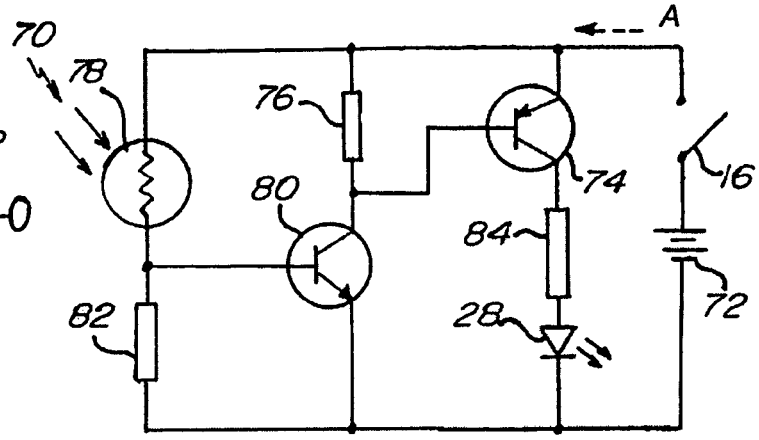
FIG. 5 is an electrical schematic for the electrical control circuit, battery, photocell and LED.

Now referring to FIG. 5, the electrical control circuit 70 may be appreciated. Circuit 70 is contained within the water tight housing 12 in cavity 18 and suitably also supports a battery 72 such as those (3 volts) used for watches or other small electronics. The current flowing from the battery 72 is illustrated by Arrow A. Switch 16 accessible from the outside of housing 12 suitably energizes the circuit 70. In its resting state before the switch 17 is closed, the transistor 74 is in its open or off position. Resistor 76 prevents transistor 74 from turning on by the simple closing of switch 16. As current passes to the photo cell 78, the photocell switch is normally open or off when receiving ambient light. When no light is present, the photocell closes and permits 0.3 to 0.6 millivolts to pass therethrough to second transistor 80 while second resistor 82 impedes the flow of current therebeyond. Second transistor 80 is normally off or open until it receives the 0.3 to 0.6 millivolts and closes to permit the flow of current to the first transistor 74. Turning it closed or on which permits current to pass through the third resistor 84, which is a current limit resistor, to efficiently permit illumination of the LED 28.

Figure 2:
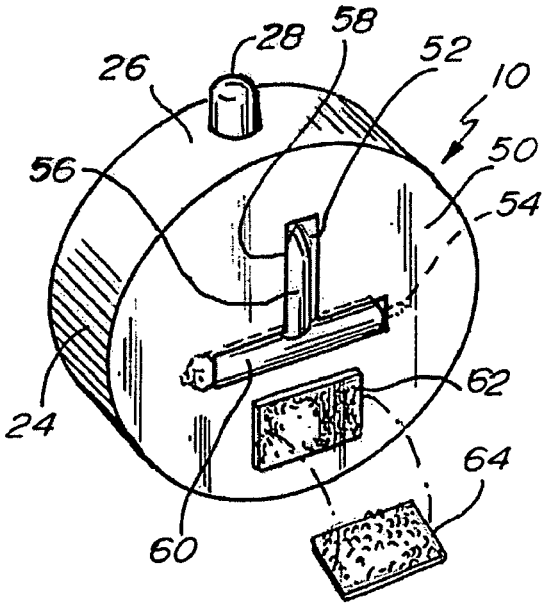
FIG. 2 is a rear elevational view of the trail light with the tack folded away and in storage position and also showing optional Velcro® hook and loop tape or material suitable for mounting without piercing an object.
Figure 3:
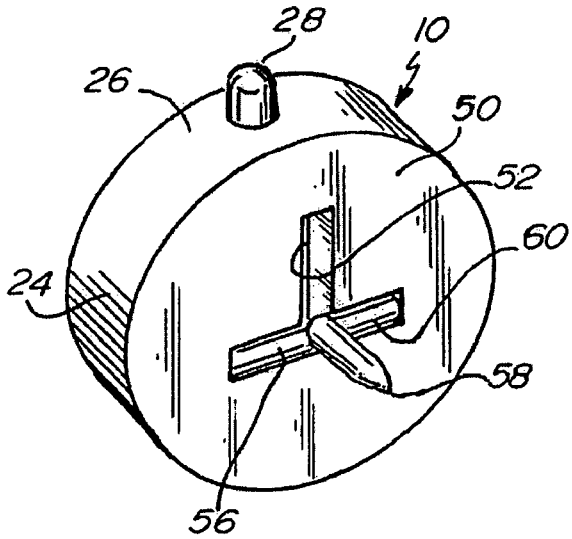
FIG. 3 is a real perspective view of the tack extended for temporarily tacking the housing to an object.

The operation of the identification and trail light 10 may be appreciated and viewed through FIGS. 1 through 3. The end user removes the light 10 from a backpack, pouch or pocket and turns the on/off switch 16 to the on position. Next, the tack 56 is pulled from its storage position in FIG. 2 to its extended position in FIG. 3 and the trail light 10 is tacked into a tree or object 5. Alternatively, the tack 56 may be retained in its storage position and matching Velcro® hook and loop patches 62 and 64 may be used where the object 5 is not suitable for piercing by tack 56.

Figure 6:
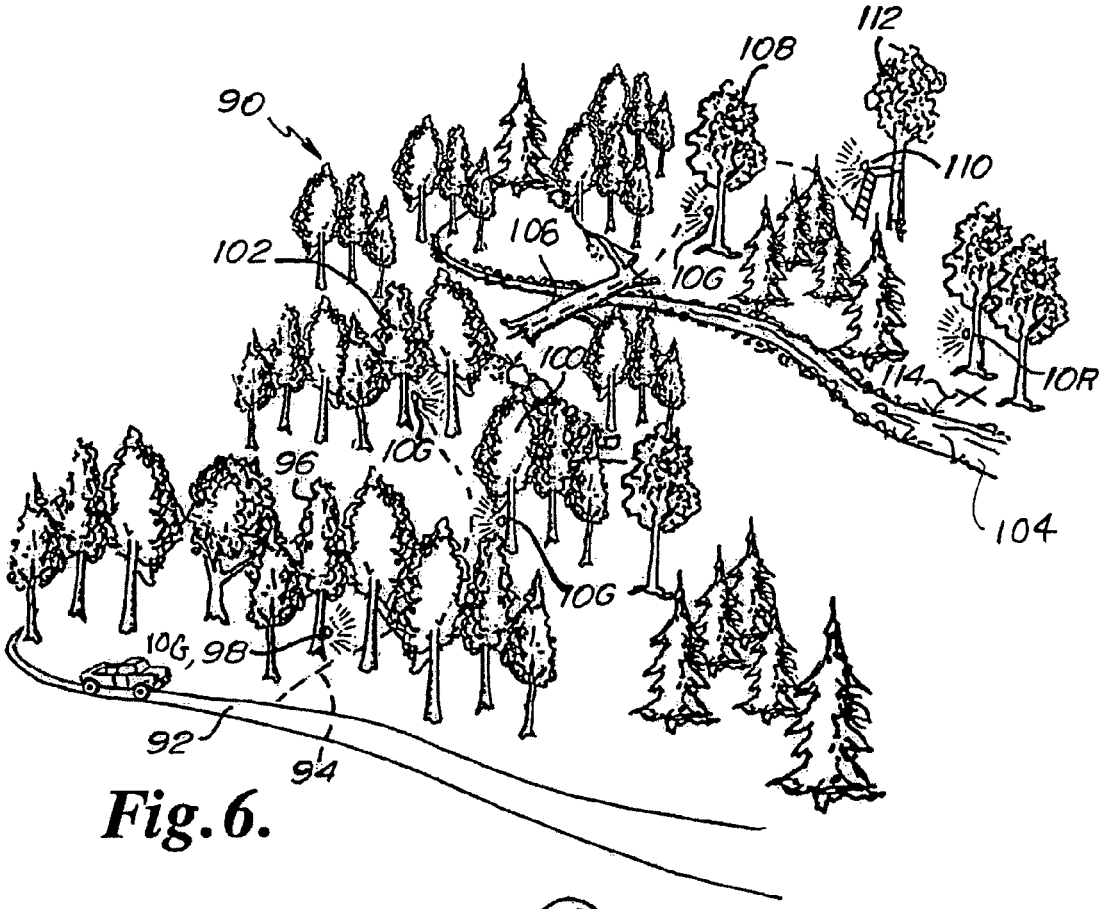
FIG. 6 is a topical illustration of a trail marked for identification at nighttime with the trail lights.

Referring to FIG. 6, the use of the trail light 10 may be more further appreciated. The individual suitably approaches the forest 90 in his vehicle on a road 92 and parks the vehicle. Suitably, a trail 94 leads through the forest 90 and is readily observable in daylight hours. There will likely be a trail entrance tree 96 nearby and the user may take a green trail light 10G and place it into the trail entrance tree 96 at 98. The trail is shown in dashed lines. A second tree 100 on the trail 94 suitably may have a green light lOG. A third tree 102 on the trail 94 also suitably may have a green light lOG. Illustratively, there may be a creek 104 passing through the forest 90 and a downed tree bridge 106 is across the creek 104, which suitably may be marked on the opposite side by a fourth tree 108 with a green trail light 10G. An elevated ladder stand 110 may be set up at fifth tree 112 whereat is located a red trail light 10R to signify the end of the trail to the hunter. In a hunting situation, the hunter has a downed animal at 114. He may mark its location with a red identification light 10R.

Figure 7:
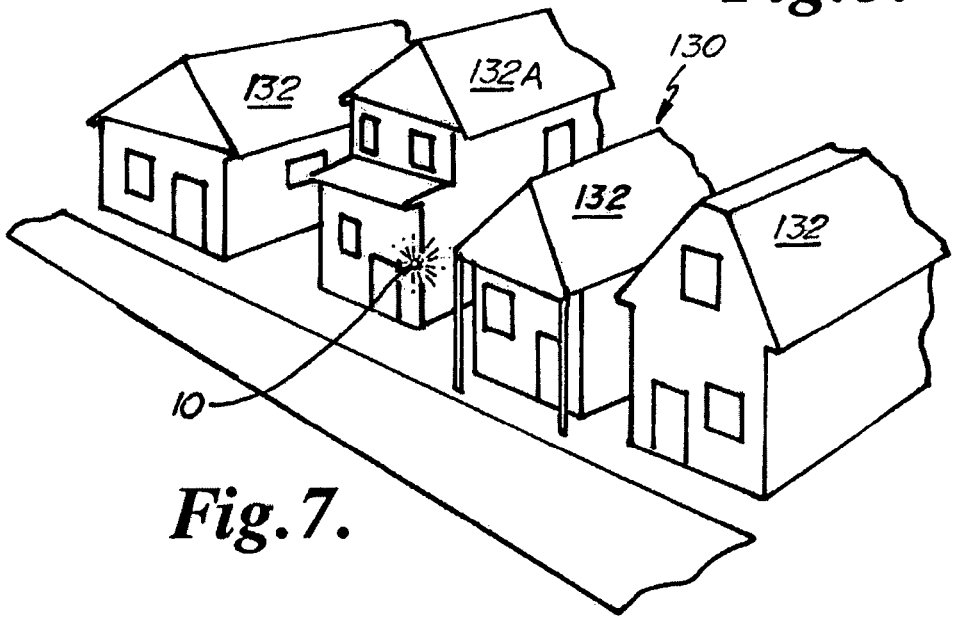
FIG. 7 is a perspective view of a house in a crowded neighborhood marked with the identification light adjacent to the front door.

Referring to FIG. 7, a crowded neighborhood 130 is illustrated with many houses 132 making it difficult for an individual to locate a particular house 132A. An identification light 10 may be affixed to house 132A for easy location by the individual searching for a particular house 132A. In this situation the light 10 may be flashing. Similarly, colored lights 10 may be used as Christmas tree lights.

Figure 8:
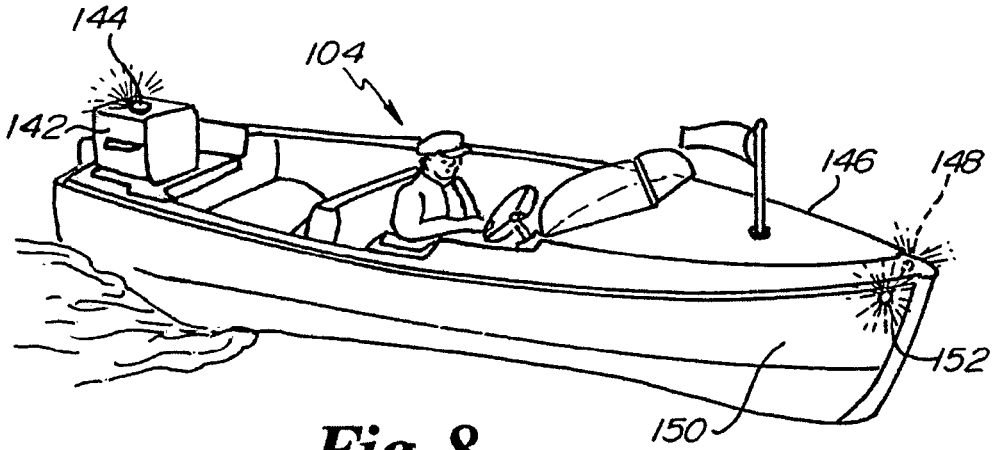
FIG. 8 is a perspective view of a vehicle or boat properly marked for nighttime operation with the identification lights.

Referring to FIG. 8, it is well known that a boat 140 operating at night must have navigation lights. Located at the stem 142 may be a white identification light 144 suitably adhered to a top portion of the stem 142 or engine. Here is an example where it would be advantageous to adhesively securable Velcro® with hook and loop patches 62 and 64. At the port bow 146 may be secured a red identification light 148 while at the starboard bow 150 a green identification light 152 may be secured.

Figure 9:
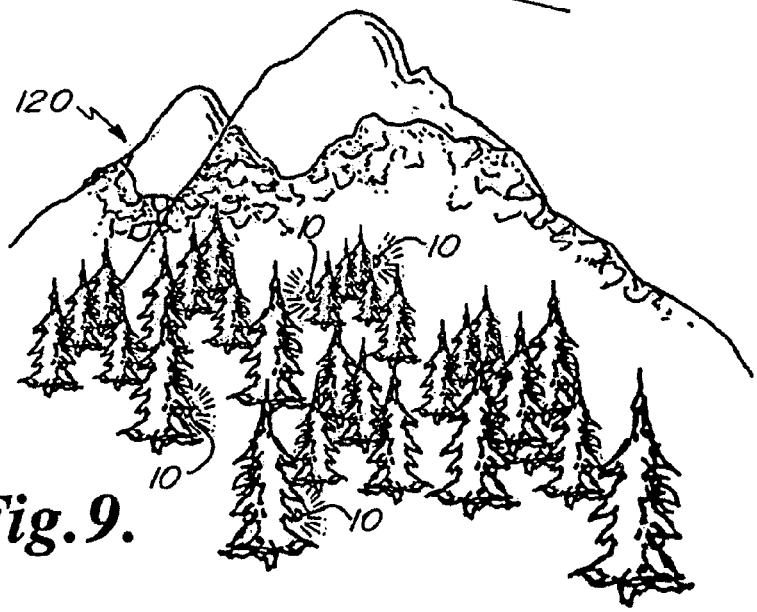
FIG. 9 is a topical illustration of the trail lights being utilized to mark the whereabouts of a lost or injured individual for nighttime identification.

Referring to FIG. 9, a dense mountainous forest 120 is illustrated with a multitude of identification lights 10 strewn about to signal a distress signal for a hunter who is lost or injured.

Figure 10:
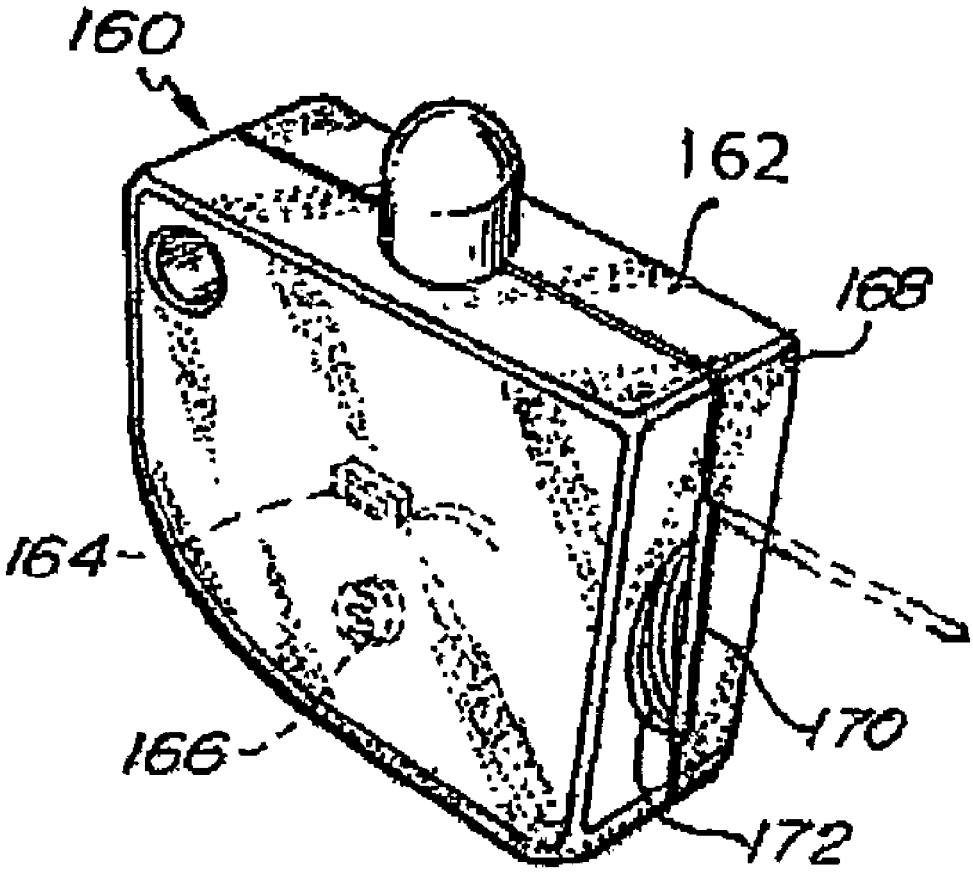
FIG. 10 is a perspective view of the light with the tack in the side of the housing.

Referring to FIG. 10, light 160 is similar to light 10 with translucent housing 162. Internally are on/off switch 164 and photocell 166 on the circuit 70. Located on sidewall 168 is fold out pin or tack 170 at thumb nail recess 172.

The scope of the invention is to be interpreted by a review of the following claims. The preceding specification and figures are for illustrative purposes only.

What is claimed:

1. An efficient, long-lasting identification and trail light suitable for storing in a pocket and marking trails and objects for nighttime identification, comprising:

(a) a short housing with a translucent portion with an internal cavity;

(b) a folding tack mounted on the housing movable from a folded away storage position to an extended position for temporarily tacking the housing to a wood object;

(c) an electrical control circuit with a battery mounted within the cavity;

(d) a light mounted on the housing and connected to the control circuit; and (e) a photocell mounted within the translucent portion of the housing and connected to the control circuit and mounted transversely to the light adjacent to the translucent portion of the housing to actuate battery power to turn on the light in darkness.

2. The light of claim 1, further comprising an on/off switch on the circuit within the housing to turn on the circuit.

3. The light of claim 1, wherein the light is a light-emitting diode (LED).

4. The light of claim 3, wherein the LED is colored and selected from a group comprising, red, green and white.

5. The light of claim 1, wherein the light is oriented perpendicularly to the photocell.

6. The light of claim 1, wherein the housing is substantially translucent.

7. An efficient, long-lasting identification and trail light suitable for storing in a pocket and for marking trails and objects for nighttime identification, comprising:

(a) a short translucent housing with an internal cavity;

(b) a folding tack mounted on the housing movable from a folded away storage position to an extended position for temporarily tacking the housing to a wood object;

(c) an electrical control circuit with a battery mounted within the cavity;

(d) a light-emitting diode (LED) mounted on the housing and connected to the control circuit; and (e) a photocell mounted within the translucent portion of the housing and connected to the control circuit and mounted transversely to the light-emitting diode (LED) to actuate battery power to turn on the light in darkness.

8. The light of claim 7, further comprising an on/off switch on the circuit within the housing to turn on the circuit.

9. The light of claim 7, wherein the LED is colored and selected from a group comprising, red, green and white.

10. The light of claim 7, wherein the tack is "T" shaped.

11. The light of claim 7, wherein the housing is substantially translucent.

12. An efficient, long-lasting identification and trail light suitable for storing in a pocket and marking trails and objects for nighttime identification, comprising:

(a) a short translucent housing with an internal cavity;

(b) a mechanical linkage mounted on the housing for temporarily mounting the housing to an object;

(c) an electrical control circuit with a battery mounted within the cavity;

(d) a light-emitting diode (LED) mounted on the housing and connected to the control circuit; and (e) a photocell mounted within the translucent portion of the housing and connected to the control circuit and mounted transversely to the light emitting diode to actuate battery power to turn on the light in darkness.

13. The apparatus of claim 12, further comprising an on/off switch on the circuit within the housing to turn on the circuit.

14. The apparatus of claim 12, wherein the light-emitting diode (LED) is oriented perpendicularly to the photocell.

15. The apparatus of claim 14, wherein the LED is colored and selected from a group consisting of red, green and white.

16. The apparatus of claim 12, wherein the mechanical linkage is from a group comprising a folding tack mounted on the housing movable from a folded away storage position to an extended position, adhesively securable hook and loop patches and adhesive.

17. An efficient, long-lasting identification and trail light suitable for storing in a pocket and marking trails and objects for nighttime identification, comprising:

(a) a short translucent housing with an internal cavity;

(b) a mechanical linkage for temporarily tacking the housing to an object;

(c) an electrical control circuit with a battery mounted within the cavity;

(d) a light-emitting diode mounted on the housing and connected to the control circuit;

(e) an on/off switch on the circuit within the housing to turn on the circuit; and (f) a photocell mounted within the translucent portion of the housing connected to the control circuit and mounted transversely to the light-emitting diode to actuate battery power to turn on the light in darkness.

18. The apparatus of claim 17, wherein the LED is colored and selected from a group consisting of red, green and white.

19. The apparatus of claim 17, wherein the mechanical linkage is from a group comprising a folding tack mounted on the housing movable from a folded away storage position to an extended position, adhesively securable hook and loop patches and adhesive.

* * * * *